United States Patent [19]

DiVeto

[11] 3,963,188

[45] June 15, 1976

[54] LISTING MACHINE ROLL HOLDER

[75] Inventor: Hilliard R. DiVeto, Plymouth, Mich.

[73] Assignee: Burroughs Corporation, Detroit, Mich.

[22] Filed: Dec. 6, 1974

[21] Appl. No.: 530,419

[52] U.S. Cl. ..... 242/55.2; 242/129.8

[51] Int. Cl.[2] ..... B65H 19/00; B65H 49/00

[58] Field of Search ..... 242/55.2, 55.3, 55.42, 242/55.53, 68, 68.3, 129.5, 129.8

[56] References Cited

UNITED STATES PATENTS 2,419,798 4/1947 Stone ..... 242/55.2

2,707,595 5/1955 Brown ..... 242/55.2

*Primary Examiner*—Leonard D. Christian

*Attorney, Agent, or Firm*—Larry Michael Jarvis; William B. Penn; Kevin R. Peterson

[57] ABSTRACT

A paper roll holder having a cylindrical spring freely floating about one end of a spindle to frictionally engage the inner cord of a paper roll as the roll is pushed onto the spindle, retaining the roll securely in position. A thin cylindrical tube interposed between the spring and the spindle prevents interference of the spring with the spindle during insertion and rotation of the paper roll.

7 Claims, 7 Drawing Figures

LISTING MACHINE ROLL HOLDER

BACKGROUND OF THE INVENTION

1. Field of the Invention

The invention relates to a paper roll holder for mounting a paper roll onto a spindle while providing revolubility of the roll to dispense paper, and more particularly relates to an open end paper roll holder providing quick and easy retention of a paper roll as it is slid into position over a spindle.

The roll holder is primarily intended for use in a multi-tape lister printer of a bankproof and distribution machine, wherein a plurality of rolls of paper tape are provided in association with a like plurality of printing devices and sorting pockets, such that a tally of checks distributed to each of the pockets might be automatically provided.

2. Description of the Prior Art

In business machines, such as cash registers, accounting machines, and the like, in which a paper tape is fed from a paper roll past a printing platen, it is necessary that the user be able to quickly and easily insert a new paper roll into the machine after the present roll is depleted. The necessity for immediate paper roll reloading is aggravated where the machine uses a plurality of rolls of paper tape and operates at a high rate of speed, as for example, in bankproof and distribution machines of the type having multi-tape lister printers.

Heretofore, a paper roll was mounted onto a spindle which was supported at each of its ends by an arm or bracket secured to part of the machine housing. Often a retaining device was also located at each end of the spindle to secure and align the paper roll into a stable position. In such holders the spindle was removable to permit the empty paper roll to be pulled off the spindle and a new paper roll inserted. The reloading of such a roll holder was not only time consuming but also troublesome, especially when used in multi-tape lister printers where the area of the roll holder is confined.

However, many products today utilize open end roll holders where a spindle is supported from only one of its ends, leaving the other end "open". Such open end roll holders permit a depleted paper roll to be quickly pulled off the spindle and a new roll easily inserted without any unnecessary manipulation of the spindle. But because one end of the roll holder is open, a retaining device is necessary to keep the roll from sliding off the spindle as the paper is dispensed. At the same time the retaining device must not inhibit quick insertion and extraction of the paper roll. Thus, the need has become apparent to provide a means to retain a paper roll in a secure position in an open end roll holder, while still permitting quick and easy insertion of the paper roll into the holder. In addition, it is desirable to keep the structure as simple as possible to provide low manufacturing costs of the holder.

While retaining devices are known for open end roll holders that have been proven costly to manufacture due to complexity of construction, there has been no satisfactory retaining device that provides both low cost and simplicity of construction while still permitting quick and easy insertion of a paper roll into the holder.

SUMMARY OF THE INVENTION

It is, therefore, an object of this invention to provide a low cost paper roll holder of relatively simple construction facilitating quick and easy insertion of a paper roll into the holder.

It is another object of this invention to provide a retaining device for securing a paper roll into proper position in an open end paper roll holder, which retaining device permits quick and easy insertion of the paper roll into the holder.

The objectives of the invention are accomplished in the use of a cylindrical spring to frictionally engage the inner core of a paper roll, securing the roll into proper position onto a spindle. The spring is rotatable, encompassing only one end of the spindle to permit free entry of the paper roll from the opposite end of the spindle. The spring is designed with a tapered ramp and a projecting tine which cooperate with the inner core of the paper roll as the roll is pushed onto the spindle to radially compress the spring for frictional retention of the paper roll in a desired position. To prevent the spring from interfering with the spindle during paper roll insertion and rotation, a thin cylindrical tube is juxtaposed to the inside surface of the spring to act as a cylindrical liner.

Other objects, features and advantages of the invention will be readily apparent from the following description of the preferred embodiment taken in conjunction with the appended claims and accompanying drawings.

DESCRIPTION OF THE PREFERRED EMBODIMENT

Figure 1:
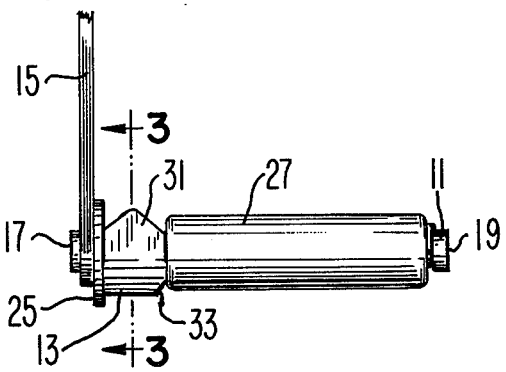
FIG. 1 is a side view of the paper roll holder of the present invention.
Figure 2:
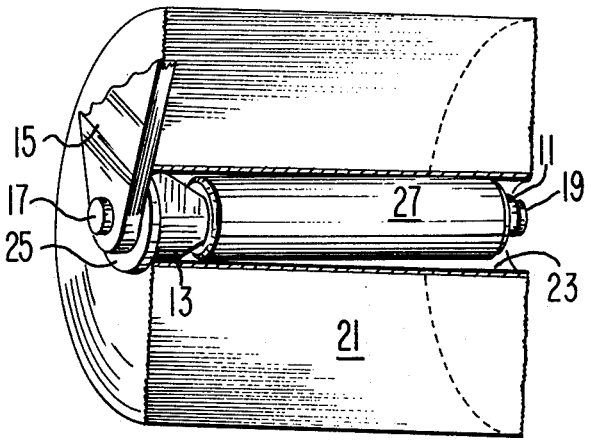
FIG. 2 is a perspective view of the paper roll holder of FIG. 1, but with a cross sectional view of the paper roll in position.

As shown in FIGS. 1 and 2, the open end roll holder of the present invention includes a cylindrical spring 13 rotatably disposed in a free floating condition, encompassing one end of a spindle 11. The spring 13 acts as a retaining device for securing a paper roll 21 onto the spindle 11 and permitting the roll to freely rotate about the spindle to dispense paper tape.

The spindle 11 is mounted in cantilever fashion at one of its ends 17, being rigidly secured to a bracket member 15 by any common means. The bracket member is adapted to be fastened to a business machine for proper feeding of the paper tape to print imparting means utilized to make a list or summation of items thereon. The other end 19 of the spindle is open, having no support arm or similar bracket affixed thereto. It is apparent that any suitable means may be employed to secure the spindle 11 in a rigid horizontal position, while leaving one end of the spindle open.

A washer 25 is concentrically disposed about the spindle and contiguous to bracket member 15 to space the paper roll from frictional interference with the bracket member as the roll rotates. A tubular sleeve 27 is similarly mounted about the spindle, having an outside diameter of sufficient size to serve as an abutment to confine the spring 13 between the sleeve 27 and the washer 25. The sleeve 27 is axially positioned to allow adequate space for the spring 13 to freely rotate about the spindle 11 while denying excessive space for unnecessary lateral shifting of the spring during paper dispensing. The washer and sleeve may be revolubly mounted to the spindle or affixed thereto.

The cylindrical spring 13 is positioned about the supported end 17 of the spindle and operates as a retaining device to keep the paper roll from sliding off of the spindle after the roll is inserted in place and during paper dispensing. The spring is designed with a tine 31 which cooperates with the inner core 23 of the paper roll to automatically compress the spring during sliding engagement of the paper roll with the spring as the paper roll is moved over the spindle. The spring design further includes a cut-away portion 33 formed in the outer surface of the spring for guiding the inner core 23 into cooperation with the tine 31 and then onto the spring 13, during paper roll loading.

Figure 3:
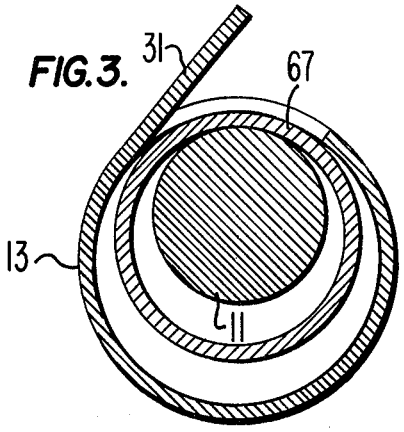
FIG. 3 is an enlarged cross sectional view taken along line 3—3 of FIG. 1.
Figure 4:
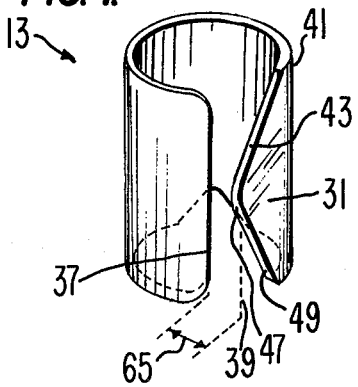
FIG. 4 is an enlarged perspective view of the retaining device of the roll holder of FIG. 1.

As illustrated in FIGS. 3 and 4, the tine 31 is constructed from the side of the cylindrical spring by an axial cut 37 made the entire length thereof. One of the edges 39 formed by the cut is bent outward along an axial line 41 to dispose the tine in a substantially tangential relationship with the perimeter of the spring. The tine is projected a sufficient distance from the perimeter of the spring to provide a proper spring bias for expansive gripping by the spring when the spring is compressed within the paper core 23. The edge 39 is reshaped to provide two ramps 43, 49 rising from the ends of the spring upward to a peak 47 to form the tine 31. A longitudinal gap 65 resulting from the tine formation, facilitates the compressibility of the spring.

Figure 5:
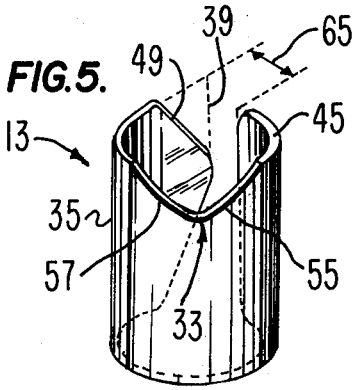
FIG. 5 shows a second perspective view of the retaining device of FIG. 4.
Figure 6:
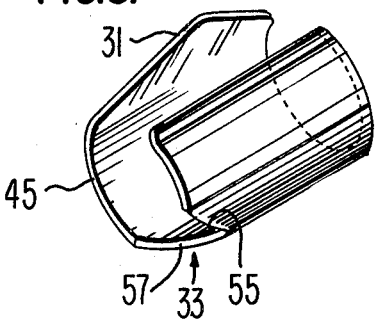
FIG. 6 shows a third perspective view of the retaining device of FIG. 4 in a different orientation.
Figure 7:
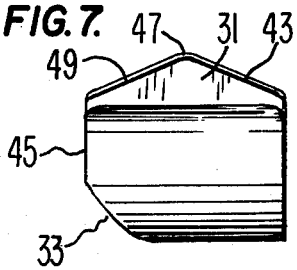
FIG. 7 shows a side view of the retaining device of FIG. 4.

Referring to FIGS. 5, 6 and 7, the cut-away portion 33 is also formed from the side of the spring by two converging cuts 55, 57 depending from the leading edge 45 of the spring and intersecting midway on the cylindrical surface 35 in a V shape configuration. As seen in FIG. 1 the cutaway portion 33 provides a tapered ramp for guiding the core of the roll onto the spring, eliminating possible interference of the roll with the spring which would occur if no ramp were provided, i.e., interference caused by the roll striking that portion of the leading edge of the spring hanging lower than the sleeve 27.

As the paper roll is moved over the spindle, the ramp 49 of the tine and the tapered ramp 33 guide the paper core over the spring, continuously compressing the spring along its travel. The tapered ramp guides the paper core into sliding engagement with the tine which bends inwardly to compress the spring within the paper core.

The spring may be fabricated from metal, plastic or any other material which provides enough resiliency when in a compressed state to produce a radially outward bias sufficient to expand the spring within the paper core to frictionally retain the roll onto the spindle. At the same time the bias must permit the paper roll to be quickly and easily pulled from the spindle during the reloading of the roll holder.

The inside surface of the spring is irregular in shape resulting from the tine 31 and the cut-away portion 33 being integrally fabricated from the side of the spring.

The longitudinal gap 65 resulting from the tine formation may allow the spring to become wedged onto the spindle during insertion and during rotation of the paper roll. Thus, to prevent any interference between the spring and the spindle, a thin cylindrical tube 67 may be floatingly interposed therebetween as illustrated in FIG. 3.

The tube 67 acts as a liner for the spring, providing an arcuate surface upon which to support the spring during compression thereof. The tube 67 must be of sufficient diameter to permit the spring to compress to its fullest extent without binding about the tube. Thus, during spring compression the interposed tube cooperates with the inside surface of the spring 13 permitting the spring to easily compress without becoming wedged onto the spindle or interfering with the tube itself.

In use, the paper roll is easily pushed onto the spindle causing automatic compression of the spring into expansive frictional engagement with the inside surface of the paper core. The spring permits the paper roll to freely rotate about the spindle, without the roll sliding off the spindle. In a quick and easy manner the paper roll is pulled from the spindle to permit reloading of the holder.

The shape of the roll retaining spring is designed in a novel and inexpensive manner, and it is apparent to those skilled in the art that a more intricate design may be fashioned which may serve to eliminate the interposing tube.

Accordingly, many modifications of the disclosed device will suggest themselves to persons skilled in the art, and it is not intended to limit the invention to the form shown but to all modifications which fall within the scope of the appended claims.

What is claimed is:

1. A listing machine roll holder for multi-tape lister printers or the like for supporting a paper roll having a hollow core, said roll holder comprising:

a spindle adapted to be rigidly supported at one end;

a cylindrical spring flotatably disposed to encompass the spindle at said one end thereof;

confinement means for axially restricting said spring to the proximity of said one end of said spindle;

compression means integrally formed on said spring for compressing said spring by cooperative sliding frictional engagement of said compression means with the inside surface of a core of a roll as the roll is axially moved over said spindle from said other end thereof; and guide means integrally formed on said spring for guiding the core of the roll into frictional engagement with said compression means.

2. A holder for a roll having a hollow core as recited in claim 1 wherein:

said compression means includes a tine extending outwardly from said spring; and said guide means includes a ramp portion disposed in the side of said spring.

3. A holder for a roll having a hollow core as recited in claim 2 wherein:

said spring includes means forming a gap therein for facilitating the compressibility of said spring;

and wherein said holder further includes:

liner means interposed between said spring and said spindle for keeping said spring from interfering with said spindle.

4. A holder for a roll having a hollow core comprising:

a spindle mounted at one end on a support and projecting therefrom;

a cylindrical spring flotatably disposed on said spindle to revolve about the spindle at said one end thereof, said spring being compressible to provide an outward bias with respect to a hollow core of a roll axially positioned thereover;

confinement means on said spindle to axially restrict said spring to the proximity of said one end of said spindle and permitting minimal axial displacement of said spring;

compression means formed on said spring for cooperating with a roll to compress said spring into expansive frictional engagement with the inside surface of the core of the roll and providing said outward bias with respect to the core of a roll as the roll is axially moved over said spindle from the other end thereof; and guide means formed on said spring for guiding a roll core into cooperation with said compression means.

5. A holder for a roll having a hollow core as recited in claim 4 wherein:

said compression means includes a tine extending outwardly from said spring; and said guide means includes a ramp portion disposed in the outer surface of said spring.

6. A holder for a roll having a hollow core as recited in claim 5, wherein:

said spring includes means forming a gap therein for facilitating the compressibility of said spring;

and wherein said holder further includes:

liner means interposed between said spring and said spindle for keeping said spring from interfering with said spindle.

7. A holder for a roll having a hollow core comprising:

a spindle adapted to be rigidly supported at one end;

a cylindrical spring revolubly mounted to encompass the spindle at said one end thereof;

compression means integrally formed on said spring for cooperating with a core of a roll for compressing said spring into expansive frictional engagement with the inside surface of the core of the roll as the roll is axially moved over said spindle from the other end thereof; and guide means integrally formed on said spring for guiding the core of the roll onto said spring.

* * * * *